US008687951B2

(12) United States Patent
Servidio

(10) Patent No.: US 8,687,951 B2
(45) Date of Patent: Apr. 1, 2014

(54) HALOGEN WATER HEATER

(76) Inventor: Patrick F. Servidio, Cos Cob, CT (US)

( * ) Notice: Subject to any disclaimer, the term of this patent is extended or adjusted under 35 U.S.C. 154(b) by 523 days.

(21) Appl. No.: 12/877,751

(22) Filed: Sep. 8, 2010

(65) Prior Publication Data

US 2011/0058797 A1 Mar. 10, 2011

Related U.S. Application Data

(60) Provisional application No. 61/240,514, filed on Sep. 8, 2009.

(51) Int. Cl.
*F26B 3/30* (2006.01)

(52) U.S. Cl.
USPC ..... 392/411

(58) Field of Classification Search
USPC ..... 392/411, 407, 393, 478, 465, 312, 483, 392/496, 386, 419; 219/411, 390; 118/725; 432/219, 29
See application file for complete search history.

(56) References Cited

U.S. PATENT DOCUMENTS

| | | | | |
|---|---|---|---|---|
| 3,687,128 | A | 8/1972 | Williams | |
| 3,807,366 | A | 4/1974 | Murtland, Jr. | |
| 4,510,890 | A | 4/1985 | Cowan | |
| 5,054,107 | A | 10/1991 | Batchelder | |
| 5,371,830 | A | 12/1994 | Wachenheim | |
| 5,559,924 | A | 9/1996 | Kadotani et al. | |
| 5,590,240 | A | 12/1996 | Rezabek | |
| 5,740,315 | A * | 4/1998 | Onishi et al. | 392/489 |
| 6,205,292 | B1 | 3/2001 | Pokorny et al. | |
| 7,458,951 | B2 * | 12/2008 | Lauman et al. | 604/6.08 |
| 7,639,931 | B2 * | 12/2009 | Tsai | 392/451 |
| 7,988,666 | B2 * | 8/2011 | Zhang et al. | 604/113 |
| 2003/0026603 | A1 | 2/2003 | Castaneda et al. | |
| 2004/0184794 | A1 | 9/2004 | Johnson et al. | |
| 2005/0001047 | A1 | 1/2005 | Chamberlain, Jr. | |
| 2005/0185941 | A1 | 8/2005 | Mills | |

* cited by examiner

*Primary Examiner* — Dana Ross
*Assistant Examiner* — Renee L Miller
(74) *Attorney, Agent, or Firm* — St. Onge Steward Johnston & Reens LLC

(57) ABSTRACT

A fluid heating apparatus includes a housing containing a flattened tube and lamps. The apparatus further includes a first conduit flow-coupled to the flattened tube, the first conduit being adapted to provide fluid to the flattened tube. The apparatus further includes a second conduit flow-coupled to the flattened tube, the second conduit being adapted to channel fluid from the flattened tube. The lamps are arranged to irradiate the flattened tube, and the flattened tube is adapted to absorb radiation from the lamps and heat fluid contained therein.

17 Claims, 12 Drawing Sheets

HALOGEN WATER HEATER

CROSS-REFERENCE TO RELATED APPLICATIONS

This application claims the benefit of U.S. Provisional Application Ser. No. 61/240,514 filed on Sep. 8, 2009, entitled "Halogen Water Heater", the contents of which are incorporated herein by reference.

FIELD OF THE INVENTION

The apparatus described herein is generally directed to the field of fluid heaters; and, more directly, to the field of water heaters using halogen and/or infrared lamp heat sources.

BACKGROUND OF THE INVENTION

Fluid heaters have a variety of uses in a variety of fields. Water heaters are particularly prevalent in the domestic consumer market and the service sector. Water heaters serve a variety of purposes in these roles; however, they are most frequently used for providing hot water via plumbing systems for use in cooking, beverage preparation, bathing, washing, cleaning, heating buildings, and so forth.

Traditionally, water heaters used in a plumbing/running water capacity are reservoir-style heaters that use a natural gas open flame heat source. The water is kept at a relatively constant temperature by sporadic heating. One drawback of this design is the limited capacity of the water reservoir which leads to the exhaustion of the hot water supply under heavy loads. Another drawback is the energy wasted in keeping the stored water at a desired high temperature. This problem is compounded further if a larger reservoir is chosen to avoid shortages under heavy loads. Thus, gas/reservoir water heaters can be both inefficient and insufficient unless subjected to a fairly constant and appropriately sized load.

As a result of the above-noted drawbacks of conventional heaters and increasing producer/consumer interest in "going green," the market for on-demand heaters has expanded. On-demand heaters heat water for immediate consumption instead of storing water at a high temperature. Concurrent with this trend, there has been an increasing interest in water heaters that use other heat sources besides natural gas combustion. This shift in market paradigms has created a need for new heater designs to meet new demand and improve product offerings in the field of on-demand and alternative fuel heaters.

Fluid heaters employing an electrical radiation source, or lamp, as a heat source are currently available. In a typical design, the fluid flows through a conduit that is being irradiated by the lamps. The conduit absorbs heat and transfers it to the water therein. One common thread in these designs is that they are often not consumer friendly—particularly for unsophisticated residential and commercial users. For example, they may be bulky, complex, difficult to maintain, constructed with exotic parts, expensive, and/or designed for a heating capacity not suited to typical residential/commercial applications. Furthermore, many of these designs may be inefficient at delivering all of the heat produced to the fluid.

There remains a need in the art for a lamp heated water heater that is inexpensive, efficient, size-appropriate for residential/commercial use, and easy to maintain for any user.

BRIEF SUMMARY OF THE INVENTION

A fluid heating apparatus includes a housing containing a flattened tube and lamps. The apparatus further includes a first conduit flow-coupled to the flattened tube, the first conduit being adapted to provide fluid to the flattened tube. The apparatus further includes a second conduit flow-coupled to the flattened tube, the second conduit being adapted to channel fluid from the flattened tube. The lamps are arranged to irradiate the flattened tube, and the flattened tube is adapted to absorb radiation from the lamps and heat fluid contained therein.

In one embodiment, the lamps are mounted to the housing. In another embodiment, the lamps are mounted to the flattened tube. In one embodiment, the apparatus has a hinged panel on the housing. In one embodiment, the lamps are mounted to the hinged panel. In another embodiment, the apparatus has several hinged panels on the housing and the lamps are mounted to the several hinged panels. In another embodiment, an insulating layer surrounds the housing. In another embodiment, an insulating layer is within the housing. In one embodiment, the insulating layer coats the inner surface of the housing. In one embodiment, the lamps are mounted in direct contact with the flattened tube. In one embodiment, the lamps are arranged in matching pairs on either side of the flattened tube. In one embodiment, the lamps are halogen lamps. In another embodiment, the lamps are heat lamps.

A fluid heating apparatus includes a housing containing a heat exchanger and lamps. The apparatus further includes a first conduit flow-coupled to the heat exchanger, the first conduit being adapted to provide fluid to the heat exchanger. The apparatus further includes a second conduit flow-coupled to the heat exchanger, the second conduit being adapted to channel fluid from the heat exchanger. The apparatus further includes an insulating layer surrounding the lamps. The lamps are arranged to irradiate the heat exchanger, and the heat exchanger is adapted to absorb radiation from the lamps and heat fluid contained therein.

In one embodiment, the insulating layer has a first section covering a portion of the housing where the lamps are mounted and a second section covering a portion of the housing where the lamps are not mounted. In one embodiment, the lamps are halogen lamps. In another embodiment, the lamps are heat lamps.

A fluid heating apparatus includes a housing containing an inner coil and an outer coil. The apparatus further includes a first conduit flow-coupled to the inner coil. The apparatus further includes a second conduit flow-coupled to outer coil. The apparatus further includes lamps coupled to the housing and arranged to irradiate the outer coil. The apparatus further includes a U-bend that flow-couples the outer coil to the inner coil. The outer coil is adapted to absorb radiation from the lamps and heat fluid contained therein.

In one embodiment, the inner coil and outer coil are coils of copper tubing. In one embodiment, the U-bend protrudes from the housing. In one embodiment, the U-bend is contained within the housing. In one embodiment, a flow meter is coupled to the U-bend. In another embodiment, a flow controller is coupled to the U-bend. In one embodiment, an insulating layer surrounds the housing and lamps.

In one embodiment, the apparatus includes a heating chamber containing a lamp having a second end flow-coupled to a first end of the housing. The apparatus further includes a fan chamber containing a fan having a second that is flow-coupled to a first end of the heating chamber. The apparatus further includes an air conduit having a first end flow-coupled to the second end of the housing, and having a second end that is flow-coupled to a first end of the fan chamber. The apparatus is adapted such that air current is delivered from the fan into the heating chamber, the air is heated by the lamp, the air flows over and heats the heat exchanger, and the air flows through the air conduit and returns to the fan chamber.

DETAILED DESCRIPTION OF THE INVENTION

A fluid heating apparatus includes a housing containing a flattened tube and lamps. The apparatus further includes a first conduit flow-coupled to the flattened tube, the first conduit being adapted to provide fluid to the flattened tube. The apparatus further includes a second conduit flow-coupled to the flattened tube, the second conduit being adapted to channel fluid from the flattened tube. The lamps are arranged to irradiate the flattened tube, and the flattened tube is adapted to absorb radiation from the lamps and heat fluid contained therein.

Halogen and/or infrared lamps convert a large portion of the power they consume into heat. The housing retains heat generated by the lamps, and thermal insulation improves the efficiency of the fluid heating apparatus. Thus, fluid heating apparatuses as described herein have been found to provide efficient and effective heating for a variety of applications. Fluid heating apparatuses as described herein are useful for residential, commercial, and industrial use. The fluid heating apparatuses are advantageously employed to supply heated fluid in a variety of situations having a variety of levels of demand for heated fluid. Embodiments vary in size to accommodate a diversity of applications. Fluid heating apparatuses as described herein can be used to heat fluid for use in common household applications. For example, the apparatuses described herein can be used to heat water for use in a swimming pool.

Figure 1:
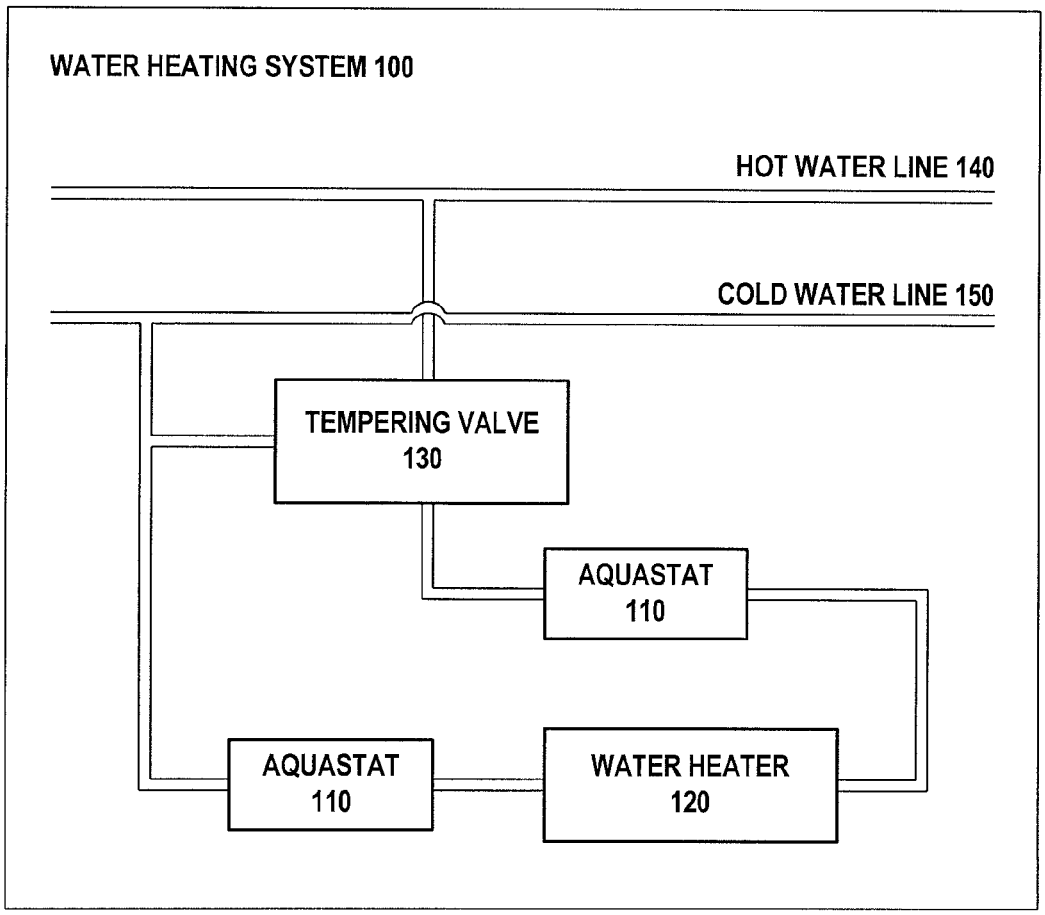
FIG. 1 is a water heating system incorporating an embodiment of the fluid heating apparatus.

FIG. 1 is a water heating system 100 employing a fluid heating apparatus or water heater 120 according to one embodiment. Water is supplied to water heater 120 from cold water line 150. Water heater 120 heats the water. Aquastats 110 are placed upstream and downstream of water heater 120 to control water heater 120 and regulate its flow. The hot water is then run into tempering valve 130, which receives water from cold water line 150. Tempering valve 130 reduces the temperature of the water output from water heater 120 to a desired temperature to prevent user injuries and equipment damage. Heated water flows from tempering valve 130 to hot water line 140. Hot water line 140 supplies hot water for a domestic or commercial building, swimming pool, reservoir 1300, or any other desired load.

Figure 13:
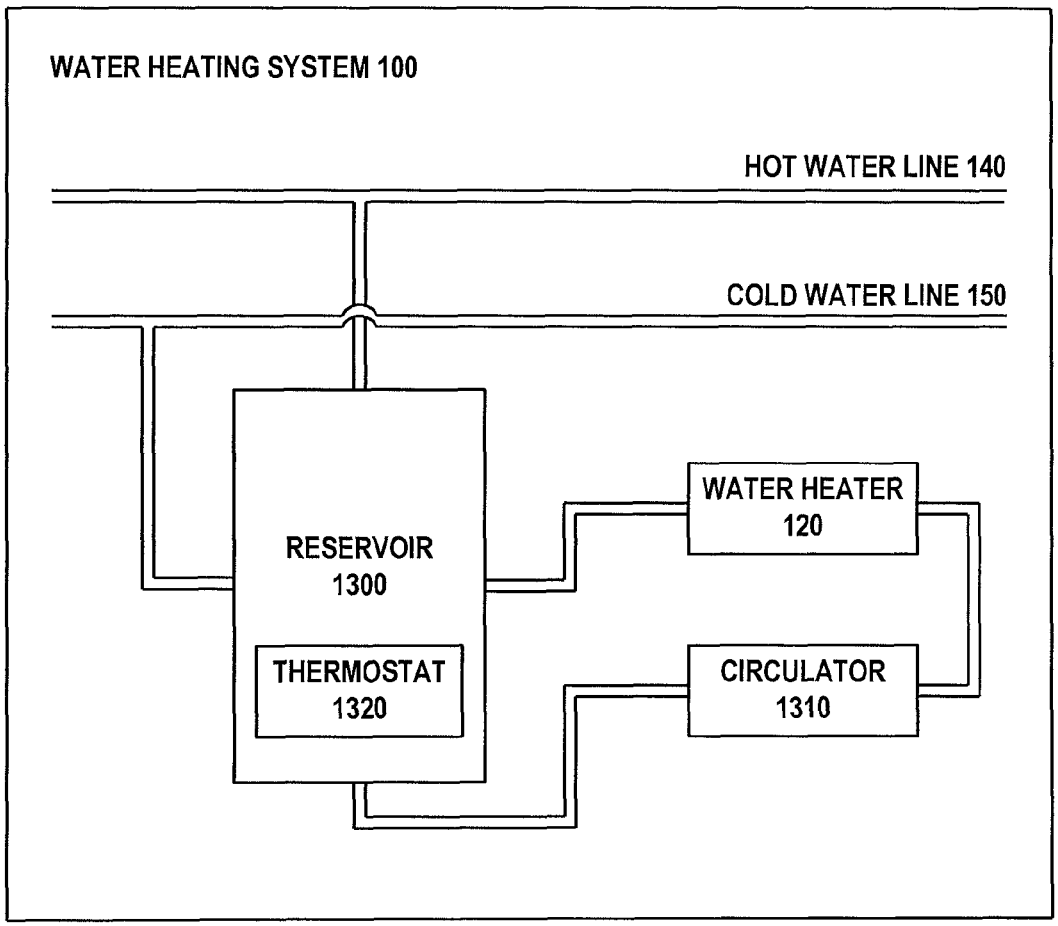
FIG. 13 is a water heating system incorporating an embodiment of the fluid heating apparatus.

FIG. 13. is a water heating system 100 employing a fluid heating apparatus or water heater 120 according to one embodiment. Water is supplied to reservoir 1300 via cold water line 150. Circulator 1310 pumps water from reservoir 1300 to water heater 120. Water heater 120 heats the water as it flows through water heater 120 and returns to reservoir 1300. A thermostat 1320 connected to the reservoir controls circulator 1310 and water heater 120 to maintain a desired temperature in the reservoir's 1300 water. Reservoir 1300 supplies water to hot water line 140.

Figure 2:
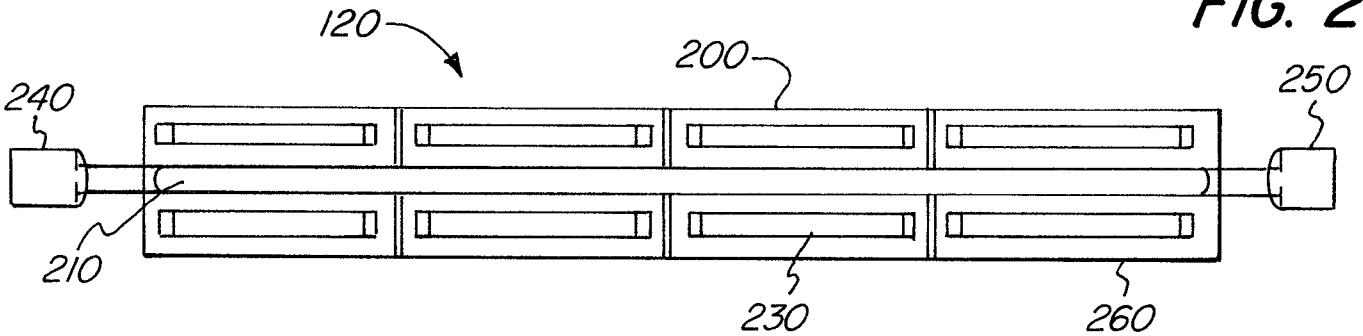
FIG. 2 is a side view of a fluid heating apparatus according to one embodiment.
Figure 3:
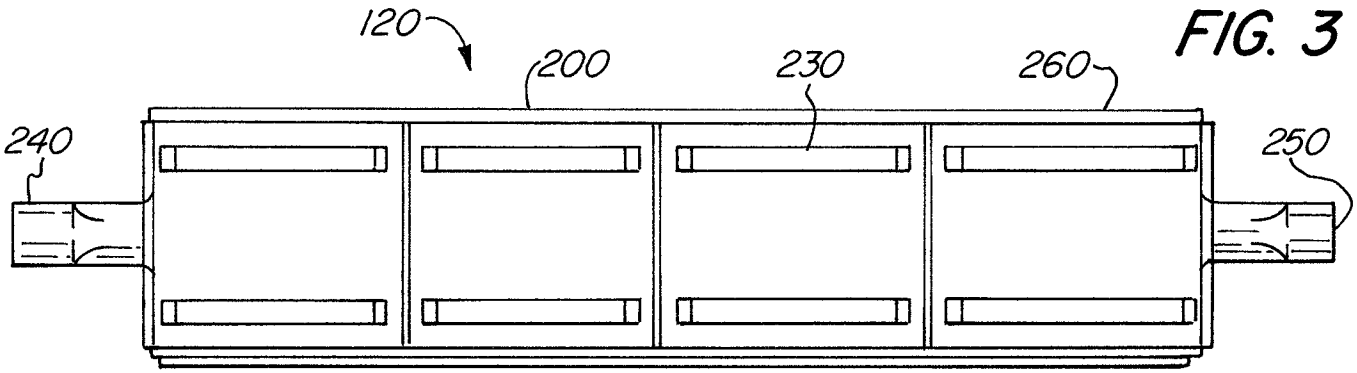
FIG. 3 is a top view of a fluid heating apparatus according to the embodiment in FIG. 2.

FIGS. 2 and 3 are a side and top view of a fluid heating apparatus 120 according to one embodiment. Fluid heating apparatus 120 comprises a housing 200 containing a heat exchanger 210 and a heat source 230. Heat exchanger 210 is a device that can absorb heat or radiation and deliver it to a fluid within it. In one embodiment, heat exchanger 210 is a section of flattened tube 210 and heat source 230 is one or more lamps 230. Flattened tube 210 is a conduit having a cross-section that is wider than it is tall. Flattened tube 210 is located in substantially the center of housing 200. Lamps 230 are arranged to irradiate flattened tube 210 on either or both of its sides. Lamps 230 are tubular halogen bulbs. In other embodiments, Lamps 230 are varying designs and shapes using a variety of substances to emit radiation.

In one embodiment, lamps 230 comprise bulbs of a generally tubular shape and lamp fixtures 420 comprise porcelain bulb holders and heavy wire bulb contacts. Lamps 230 are 500 watt each. Housing 200 is comprised of modular sections 260. Modular sections 260 are approximately 12 inches long each. Modular sections 260 have a generally ovular cross-section. First conduit 240 protrudes from housing 200 at a first end of fluid heating apparatus 120. Second conduit 250 protrudes from housing 200 at a second end of fluid heating apparatus 120. In one embodiment, housing 200 completely encloses lamps 230 and flattened tube 210. In one embodiment, fluid heating apparatus 120 comprises sixteen lamps 230; four modular sections 260, each with two lamps 230 on either side of flattened tube 210. In some embodiments, fluid heating apparatus 120 has an insulating layer 600 disposed around the exterior of housing 200. In one embodiment, insulating layer 600 is a 6 inch inner diameter, a 36 inch length, and a 2 inch thick layer of fiberglass.

Figure 16:
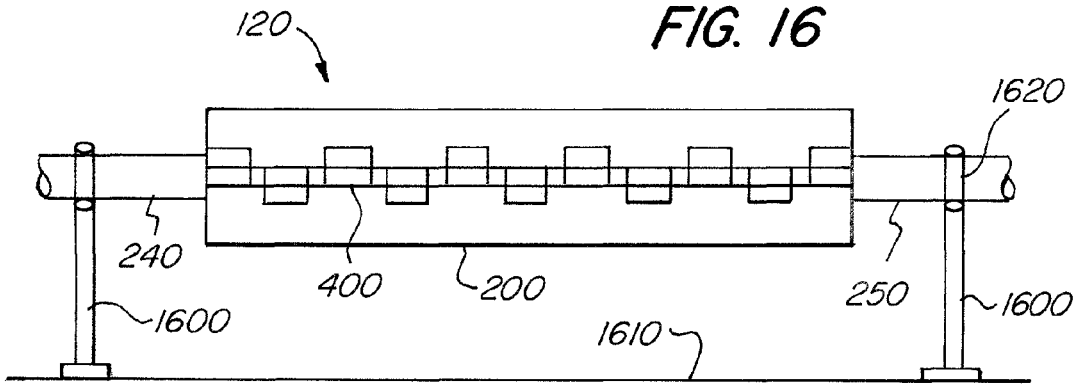
FIG. 16 is a side view of the embodiment in FIG. 2 attached to mounting system.
Figure 17:
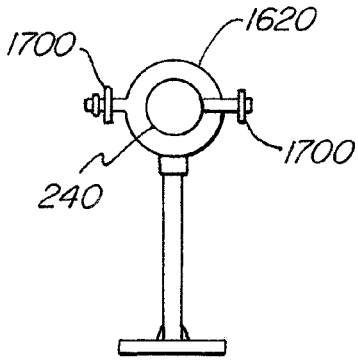
FIG. 17 is an end view of the embodiment in FIG. 2 attached to a mounting system.

FIGS. 16 and 17 show the embodiment in FIG. 2 attached a mounting system. The mounting system comprises two stands 1600. One stand 1600 is coupled to first conduit 240 by ring clamp 1620. Ring clamp 1620 clamps down on first conduit 240 to couple first conduit 240 to stand 1600. Another stand 1600 is coupled to second conduit 250 by ring clamp 1620. Ring claim 1620 clamps down on second conduit 250 to couple second conduit 250 to stand 1600. Stands 1600 are coupled to the ground 1610. Ring clamp 1620 comprises two halves and two clamp fasteners 1700. Clamp fasteners 1700 squeeze the two halves of ring clamp 1620 so as to apply pressure on first conduit 240 and mount first conduit 240 to stand 1600.

In operation, fluid enters fluid heating apparatus 120 through first conduit 240 at a first end of fluid heating apparatus 120. Lamps 230 irradiate one or both sides of flattened tube 210 and raise the temperature of the interior of housing 200 through their operation. The fluid flows through flattened tube 210 and absorbs heat from radiation from lamps 230 and the raised temperature of the interior of housing 200. The fluid then exits a second end of fluid heating apparatus 120 through second conduit 250. Thus, the fluid exiting fluid heating apparatus 120 will be at a higher temperature than the fluid entering fluid heating apparatus 120.

Figure 4:
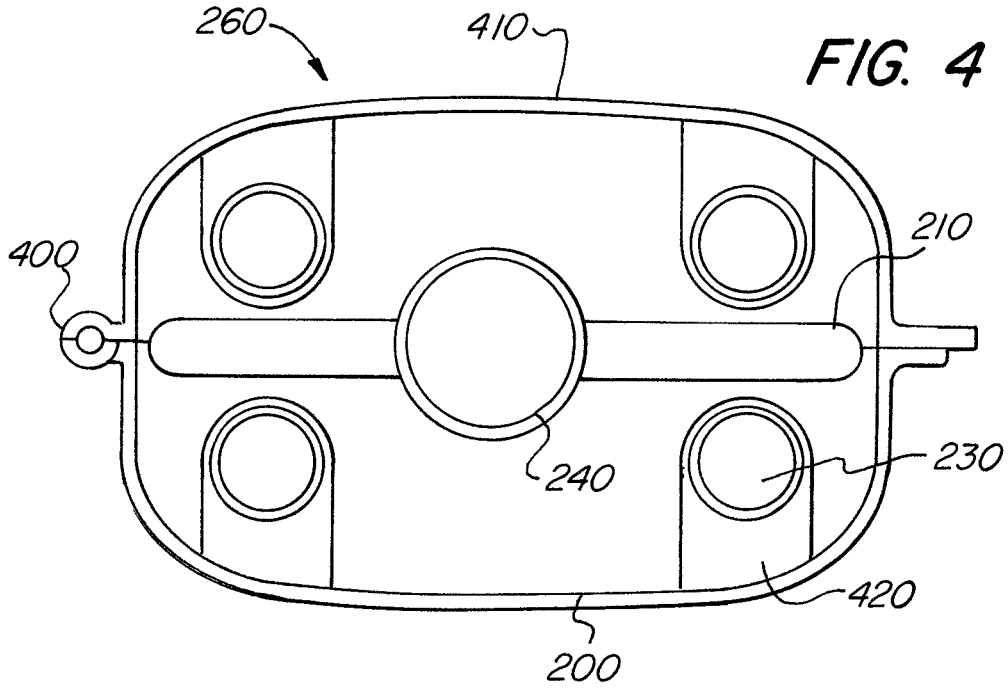
FIG. 4 is an end view of a fluid heating apparatus according to the embodiment in FIG. 2.
Figure 5:
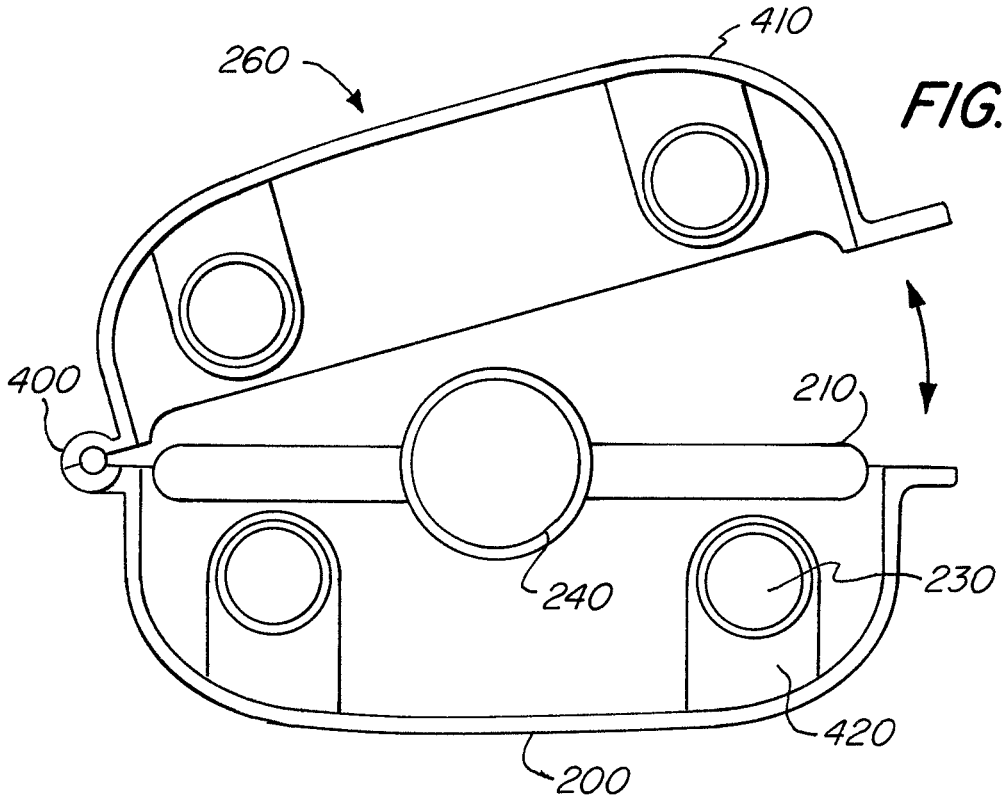
FIG. 5 is an end view of a fluid heating apparatus according to the embodiment in FIG. 2.

FIGS. 4 and 5 are an end view of fluid heating apparatus 120 according to the embodiment in FIG. 2. Each modular section 260 comprises two halves or hinged panels 410, one on each side of flattened tube 210. Lamp fixtures 420 and, by extension, lamps 230 are mounted to the hinged panels 410. Two lamp fixtures 420 are mounted on each half 410 of each modular section 260. In one embodiment, each modular section 260 has four lamp fixtures 420 mounted thereon. In several embodiments, the two halves 410 are coupled to flattened tube 210 and/or to each other by a hinged joint 400. In one embodiment, clips attach each modular section 260 to flattened tube 210. In one embodiment, each modular section 260 is press fitted to flattened tube 210. In one embodiment, clamps attach each modular section 260 to flattened tube 210. FIG. 4 shows hinged panel 410 and modular section 260 in a closed position. FIG. 5 shows modular section 260 in an open position. Although FIG. 5 only shows an upper half 410 of modular section 250 being opened, either or both halves 410 can be opened to service lamps 230. Hinged joint 400 and hinged panels 410 allow for easy servicing of fluid heating apparatus 120 and easy changing of the lamps 230. A user or technician simply opens hinged panel 410, as shown in FIG. 5, removes an expired lamp 230 from lamp fixture 420, replaces it with a new lamp 230 in lamp fixture 420, and closes hinged panel 410 as shown in FIG. 4.

Figure 6:
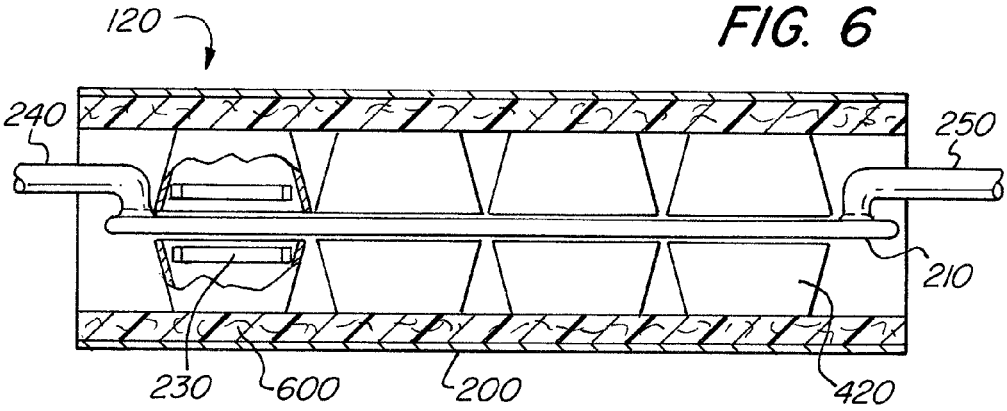
FIG. 6 is a side view of a fluid heating apparatus according to one embodiment.

FIG. 6 is a fluid heating apparatus 120 according to one embodiment. In one embodiment, heat exchanger 210 is a section of flattened tube 210, comprising one substantially flattened surface on each of two sides. Flattened tube 210 is located in substantially the center of housing 200. Lamps 230 are arranged to irradiate flattened tube 210 on either or both of its sides. Lamp fixtures 420 are mounted flush, or in direct contact with, both of the sides of flattened tube 210. In one embodiment, lamp fixtures 420 are oriented in pairs such that each pair of lamp fixtures 420 faces each other on opposite sides of flattened tube 210. In one embodiment, fluid heating apparatus 120 comprises eight lamp fixtures 420, four on each side of heat exchanger 210. In one embodiment, housing 200 completely encloses lamp fixtures 420 and heat exchanger 210. Housing 200 contains thermal insulation 600. Insulating layer 600 coats the inner surface of housing 200. In one embodiment, the insulating layer 600 comprises fiberglass insulation. First conduit 240 protrudes from housing 200 at a first end of fluid heating apparatus 120. Second conduit 250 protrudes from housing 200 at a second end of fluid heating apparatus 120.

In operation, fluid enters fluid heating apparatus 120 through first conduit 240 at a first end of fluid heating apparatus 120. Lamps 230 irradiate either or both sides of flattened tube 210 and raise the temperature of the interior of housing 200 through their operation. The fluid flows through flattened tube 210 and absorbs heat from radiation from lamps 230 and the raised temperature of the interior of housing 200. Insulating layer 600 retains heat emitted from lamps 230 in operation, which raises the internal temperature of housing 200. Heat from the hot interior of housing 200 is transferred to the fluid through flattened tube 210, thereby increasing the heat yield in the fluid and improving efficiency. The fluid then exits a second end of fluid heating apparatus 120 through second conduit 250. Thus, the fluid exiting fluid heating apparatus 120 will be at a higher temperature than the fluid entering the fluid heating apparatus 120.

Figure 7:
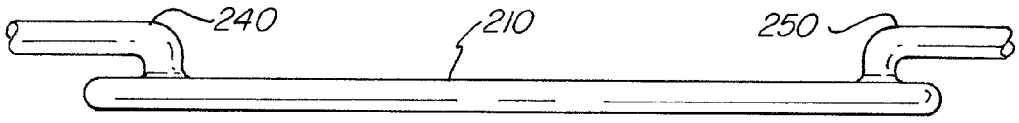
FIG. 7 is a side view of flattened tube for use in the embodiment in FIG. 6.
Figure 8:
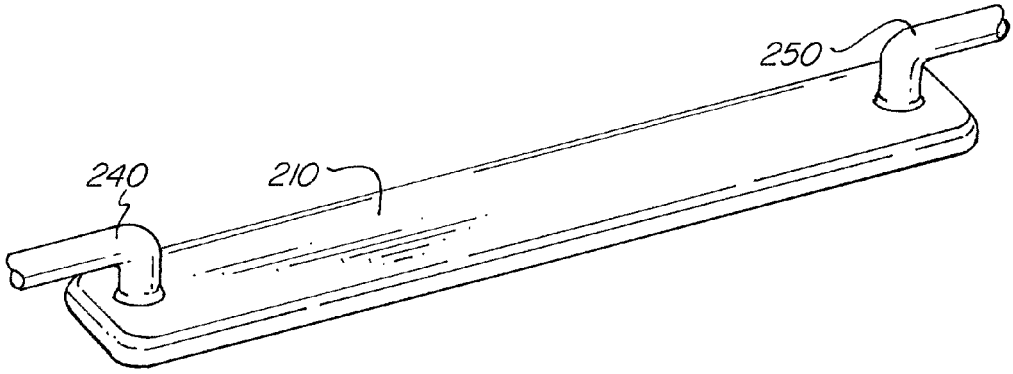
FIG. 8 is a perspective view of a flattened tube for use in the embodiment in FIG. 6.

FIGS. 7 and 8 are side and perspective views of a flattened tube 210 according to one embodiment of the fluid heating apparatus 120. Flattened tube 210 comprising one substantially flattened surface on each of two sides. Flattened tube 210 is formed to be generally rectangular to allow for a larger surface area for the absorption of heat. Flattened tube 210 is constructed from copper or other highly heat conductive material. In one embodiment, flattened tube 210 is flow-coupled to first conduit 240 and second conduit 250. First conduit 240 and second conduit 250 are coupled to the same side and same flattened surface of flattened tube 210. Flattened tube 210 is flattened so that fluid passing therethrough will be spread and a maximum volume of fluid will be placed in contact with the hottest portion of heat exchanger 210. The flat surfaces on flattened tube 210 are also convenient for arranging lamp fixtures 420 and other assembly considerations.

Figure 14:
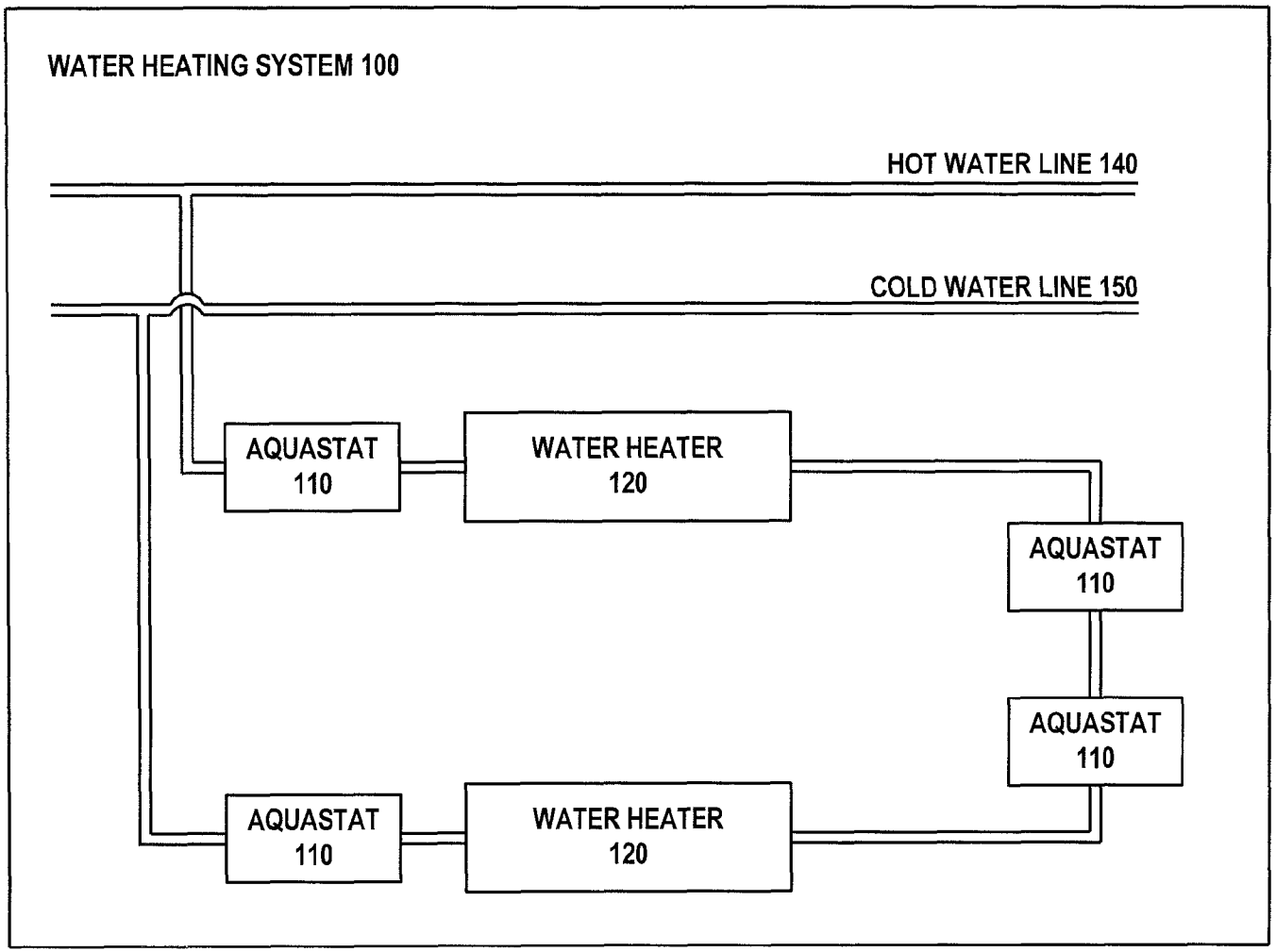
FIG. 14 is a water heating system incorporating an embodiment of the fluid heating apparatus.

FIG. 14 is a fluid heating system 100 incorporating one embodiment of fluid heating apparatus 120. This arrangement is particularly useful for fluid heating apparatuses 120 with a substantially linear shape, such as those discussed above. Fluid heating system 100 incorporates multiple fluid heating apparatuses 120 in series to accommodate higher heating demands. In one embodiment, two fluid heating apparatuses 120 are provided in series in fluid heating system 100. Heating system 100 comprises aquastats 110 disposed along the fluid flow path. Heating system 100 comprises aquastats 110 at first conduit 240 and second conduit 250 for each fluid heating apparatus 120 in fluid heating system 100.

In one embodiment of the system 100, fluid flows from cold water line 150 through first conduit 240 into a first fluid heating apparatus 120, is heated, flows through second conduit 250 of first fluid heating apparatus 120 into first conduit 240 of a second fluid heating apparatus 120, and into second fluid heating apparatus 120, is further heated, and exits through second conduit 250 of second fluid heating apparatus 120. This fluid is then supplied to hot water line 140. Aquastats 110 control the flow of fluid through the system 100. Thus, the fluid exiting fluid heating system 100 is of a higher temperature than fluid entering fluid heating system 100, and is ready to be supplied to a load in need of hot water.

Figure 9:
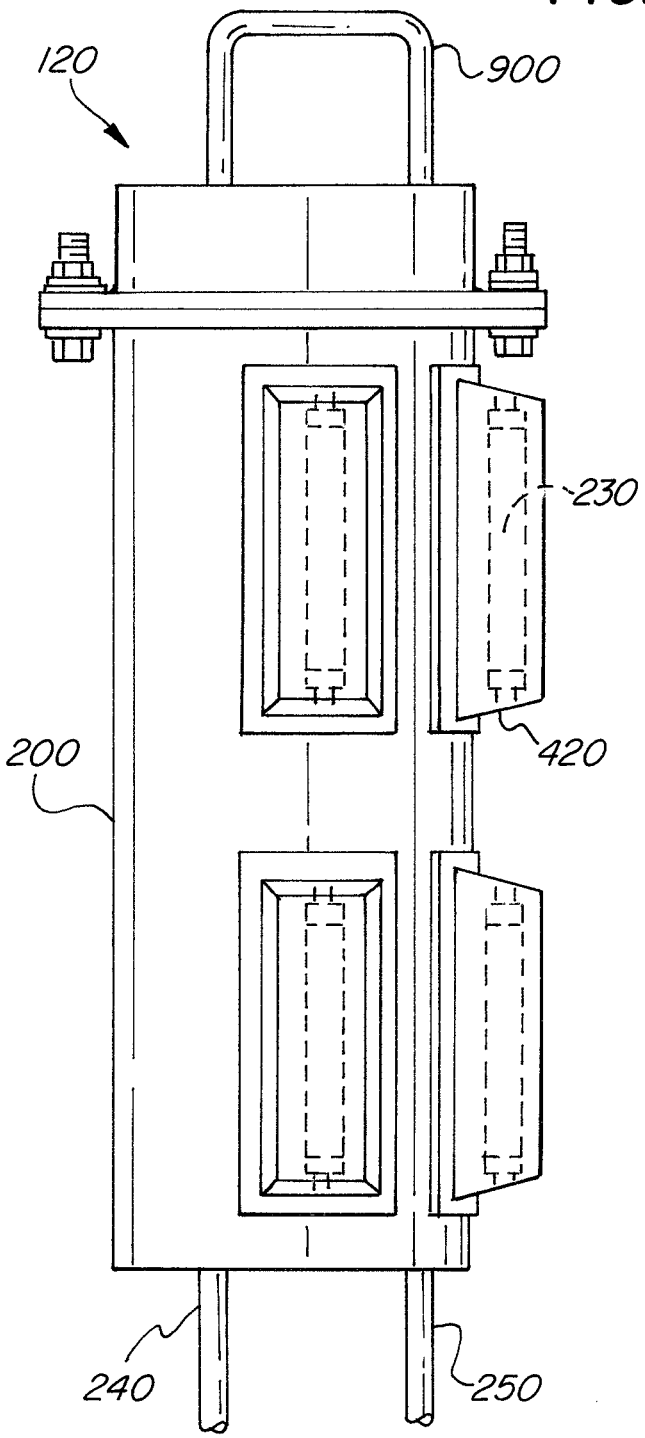
FIG. 9 is a side view of a fluid heating apparatus according to one embodiment.

FIG. 9 is a side view of one embodiment of fluid heating apparatus 120. Fluid heating apparatus 120 comprises housing 200 that is generally cylindrical and made of a metal such as stainless steel or aluminum. Heater housing 200 contains heat exchanger 210 that is flow-coupled to first conduit 240 and second conduit 250 that protrude from heater housing 200. First conduit 240 and second conduit 250 protrudes at a second end of housing 200. Heat exchanger 200 comprises a U-bend 900 that protruded from the first end of housing 200. In other embodiments, U-bend 900 is coupled to a valve to allow for control over the flow of the fluid through heat exchanger 210 and fluid heating apparatus 120. Fluid heating apparatus 120 comprises lamp fixtures 420 which are mounted to housing 200. In one embodiment, lamp fixtures 420 are mounted in rectangular openings in housing 200.

Lamp fixtures 420 contain lamps which are arranged to irradiate heat exchanger 210. In one embodiment, heat exchanger 210 is arranged adjacent to lamps 230. In one embodiment, fluid heating apparatus 120 comprises six lamps 230. In several embodiments, lamps 230 are infrared or halogen lamps. Lamps 230 are each 500 watt lamps. The size, power, and number of lamps 230 may be varied based on the heating capacity desired or the intended application of fluid heating apparatus 120.

In one embodiment, lamp fixtures 420 contain two lamps 230 each. Lamp fixture 420 have a trapezoidal cross-section and are constructed of metal or another heat-resilient material. For example, lamp fixtures 420 are built of a material that can withstand 1500-2000 degrees Fahrenheit. In one embodiment, lamp fixtures 420 are constructed of stainless steel. In one embodiment, lamp fixtures 420 are open at the broad side, or base of the trapezoid. This open broad side faces heat exchanger 210 when mounted in fluid heating apparatus 120 or on housing 200, so as to direct radiation at heat exchanger 210. In one embodiment, lamp fixtures 420 are affixed to fluid heating apparatus 120 by hinges. The hinges allow easy access to change the lamps 230. In one embodiment, the inner surfaces of lamp fixtures 420 and/or housing 200 are coated with a reflective material so as to reflect radiation internally and direct it toward heat exchanger 210. This improves the efficiency of fluid heating apparatus 120 by preventing radiation from being absorbed by housing 210 or fixtures 420 instead of being absorbed by heat exchanger 210 and the fluid.

In operation, a fluid flows into fluid heating apparatus 120, through heat exchanger 210, and out of fluid heating apparatus 120. In one embodiment the fluid is water. In one embodiment, the fluid enters fluid heating apparatus 120 through first conduit 240, flows through heat exchanger 210, flows through U-bend 900, flows through heat exchanger 210 a second time, and exits fluid heating apparatus 120 through second conduit 250. Lamps 230 irradiate heat exchanger 210 and the fluid, increasing their temperature. A certain amount of heat emitted from lamps 230 is retained in housing 200, which raises the temperature of heat exchanger 210 and raises the temperature of the fluid. This improves the efficiency of fluid heating apparatus 120 by transferring heat that would otherwise be wasted to the fluid. Thus, fluid flowing out of fluid heating apparatus 120 is at a higher temperature than fluid flowing into fluid heating apparatus 120.

Figure 10:
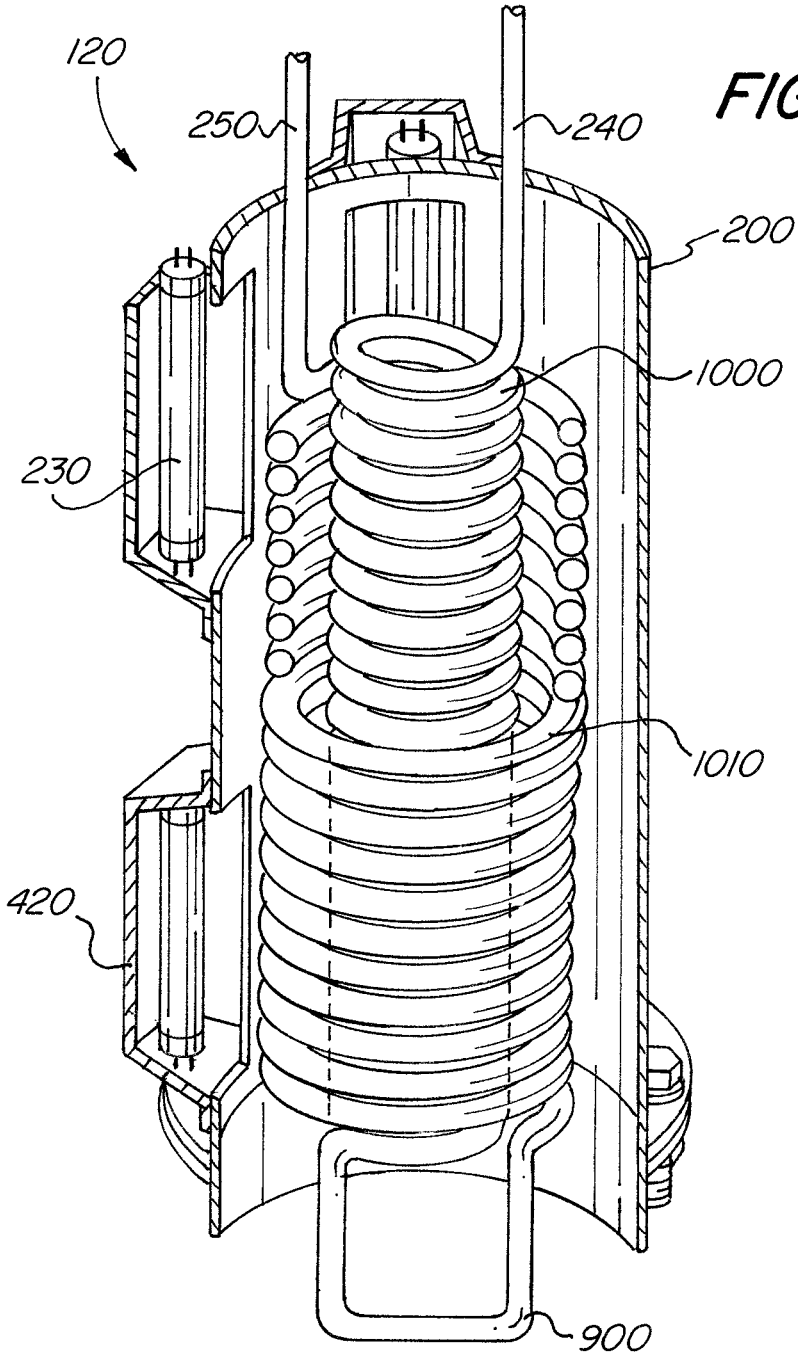
FIG. 10 is a cutaway view of a fluid heating apparatus according to the embodiment in FIG. 9.

FIG. 10 is a perspective view of one embodiment of fluid heating apparatus 120. Housing 200 contains heating element 210. Heating element 210 comprises an inner coil 1000 and an outer coil 1010, which are arranged coaxially. In one embodiment, inner coil 1000 and outer coil 1010 are constructed of coiled copper tubing. Inner coil 1000 and outer coil 1010 are flow-coupled by U-bend 900. In one embodiment, first conduit 240 is flow-coupled to inner coil 1000 and second conduit 250 is flow-coupled to outer coil 1010. First conduit 240 and second conduit 250 protrude from housing 200. In one embodiment, first conduit 240 and second conduit 250 protrude from a second end of housing 200. Fluid heating apparatus 120 comprises lamp fixtures 420 which contain lamps 230 and are mounted to housing 200.

In operation, lamps 230 directly irradiate and heat outer coil 1010. In one embodiment, fluid enters fluid heating apparatus 120 through first conduit 240, flows through inner coil 1000, through U-bend 900, through outer coil 1010, and exits fluid heating apparatus 120 through second conduit 250. In one embodiment, this operation is reversed so that the fluid enters fluid heating apparatus 120 through second conduit 250, flows through outer coil 1010, through U-bend 900, through inner coil 1000 and exits fluid heating apparatus 120 through first conduit 240. This aspect of the design could be selected based on the intended application of fluid heating apparatus 120 because it can affect the temperature of the fluid exiting fluid heating apparatus 120.

Figure 11:
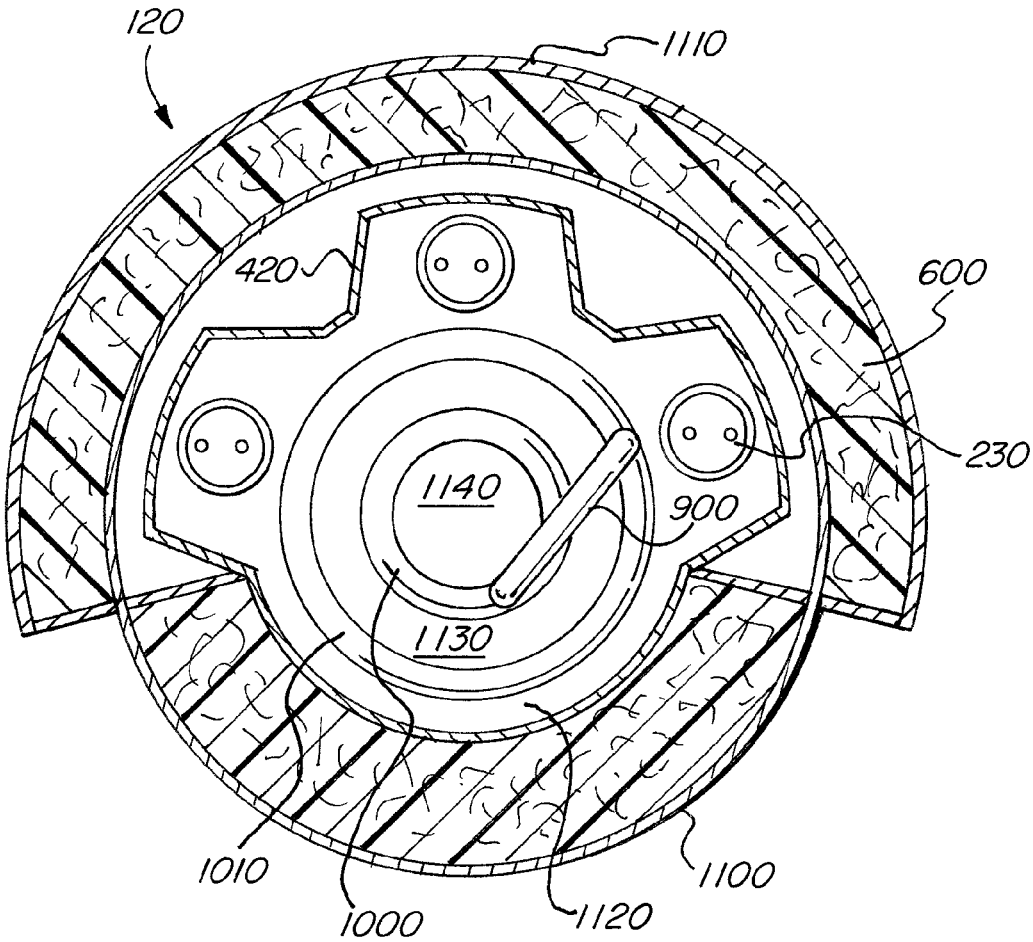
FIG. 11 is an end view of a fluid heating apparatus according to one embodiment.

FIG. 11 is an end view of a fluid heating apparatus 120 according to one embodiment. An insulating layer 600 surrounds housing 200 and lamp fixtures 420. In one embodiment, a first section 1100 of outer thermal insulation 600 covers a portion of housing 200 where lamp fixtures 420 are not mounted and a second section 1110 of outer thermal insulation 600 covers a portion of housing 200 where lamp fixtures 420 are mounted. Insulating layer 600 is configured to substantially or completely surround housing 200 and lamp fixtures 420. In one embodiment, second section 1110 of outer thermal insulation 600 is generally thinner than first section 1100 of outer thermal insulation 600. In one embodiment, second section 1110 is 2" thick and first section 1100 may be 3" thick. In one embodiment, insulating layer 600 has a stainless steel or other suitable backing layer or support.

In one embodiment, there are three rows of lamp fixtures 420 mounted to housing 200. In one embodiment, there is a first space 1120 between outer coil 1010 and housing 200, a second space 1130 between inner coil 1000 and outer coil 1010, and a third space 1140 in the center of inner coil 1000. Insulation or materials having other thermal qualities could be disposed in these spaces. For example, in one embodiment, insulation is used in second space 1130, while heat-conducting material is used in first space 1120. Thermal insulation material or a cylindrical conduit could be placed in third space 1140.

Insulating layer 600 retains heat generated from the operation of lamps 230, which is delivered to the fluid in flattened tube 210. This improves the efficiency of fluid heating apparatus 120. Fluid heating apparatus 120 is easy to disassemble and service. Insulating layer 600 is removable so that fluid heater 120 can be easily serviced. In one embodiment, lamps fixtures 420 are mounted to housing 200 by four bolts. A technician or user replaces a lamp 230 in one embodiment by removing second section 1110 of outer thermal insulation 600, removing the four bolts, removing lamp fixture 420, and replacing lamp 230 therein.

Figure 12:
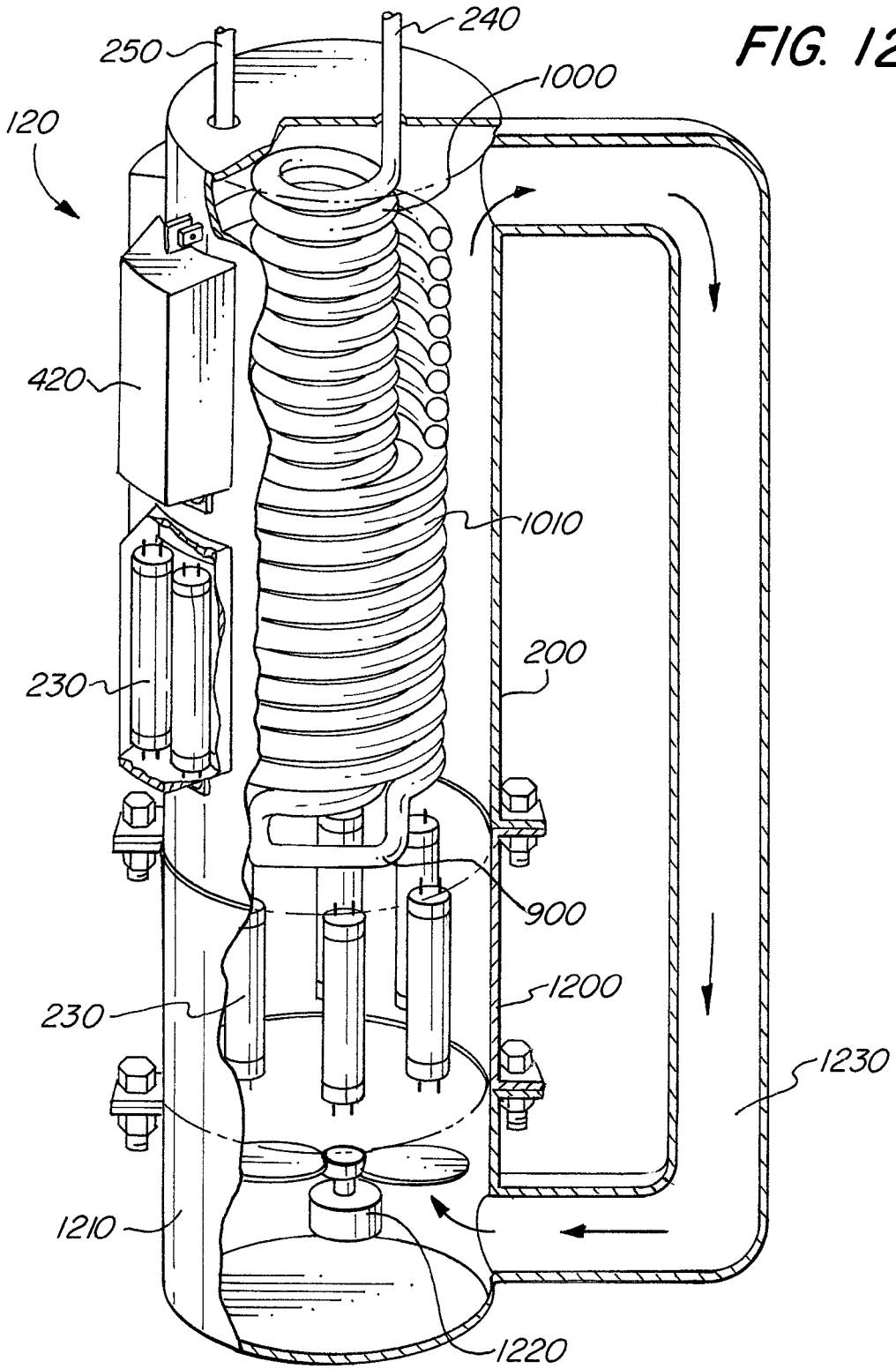
FIG. 12 is a cutaway view of a fluid heating apparatus according to one embodiment.

FIG. 12 is a fluid heating apparatus 120 according to one embodiment. In one embodiment, fluid heating apparatus 120 is a domestic or heated base board water heater. In one embodiment, fluid heating apparatus 120 comprises a heating chamber 1200 and a fan chamber 1210. Heating chamber 1200 contains lamps 230. Fan chamber 1210 contains a fan 1220. Fluid heating apparatus 120 further comprises an air conduit 1230. The second end of fan chamber 1210 is flow-coupled to the first end of heating chamber 1200. The second end of heating chamber 1200 is flow-coupled to the first end of housing 200. The second end of housing 200 is flow-coupled to the first end of air conduit 1230. The second end of air conduit 1230 is flow-coupled to the first end of fan chamber 1210.

In one embodiment, housing 200 contains four lamp fixtures 420 containing two lamps 230 each. Heat exchanger 210 is flow coupled to U-bend 900, which is fully enclosed within housing 200. In one embodiment, heating chamber 1200 comprises six lamps 230. In one embodiment, fan 1220 is a three speed fan. In one embodiment, first conduit 240 and second conduit 250 are coupled to aquastats. In one embodiment, air conduit 1230 is approximately 3 inches in diameter. In one embodiment, air conduit 1230 is constructed of 24 gauge piping or light metal tubing. In one embodiment, air conduit 1230 is coated in 3 inch fiberglass round conduit insulation. In one embodiment, lamps 230 are 500 watt bulbs or halogen bulbs. In one embodiment, there are a total of 14 lamps 230 in fluid heating apparatus 120.

In operation, heating chamber 1200 provides heated air to housing 200, heat exchanger 210, and the fluid. In one embodiment, the aquastat 110 coupled to first conduit 240 and second conduit 250 calls for heat, lamps 230 are activated, the temperature rises inside housing 200, the heat is transferred to heat exchanger 210, fan 1220 blows air through heating chamber 1200 forcing heated air to flow around the outer surface of heat exchanger 210, and the extra heat is delivered to the fluid which exits fluid heating apparatus 120. The air returns to fan 1220 via air conduit 1230, and the cycle continues. Heating chamber 1200 increases the heating capacity of fluid heating apparatus 120 by providing additional heat to heat exchanger 210. It accomplishes this by heating air with lamps 230 within heating chamber 1200 which is blown into housing 200 by fan 1220. Air is recirculated in this system via air conduit 1230, so that a constant flow of hot air is provided to heat exchanger 210.

Figure 15:
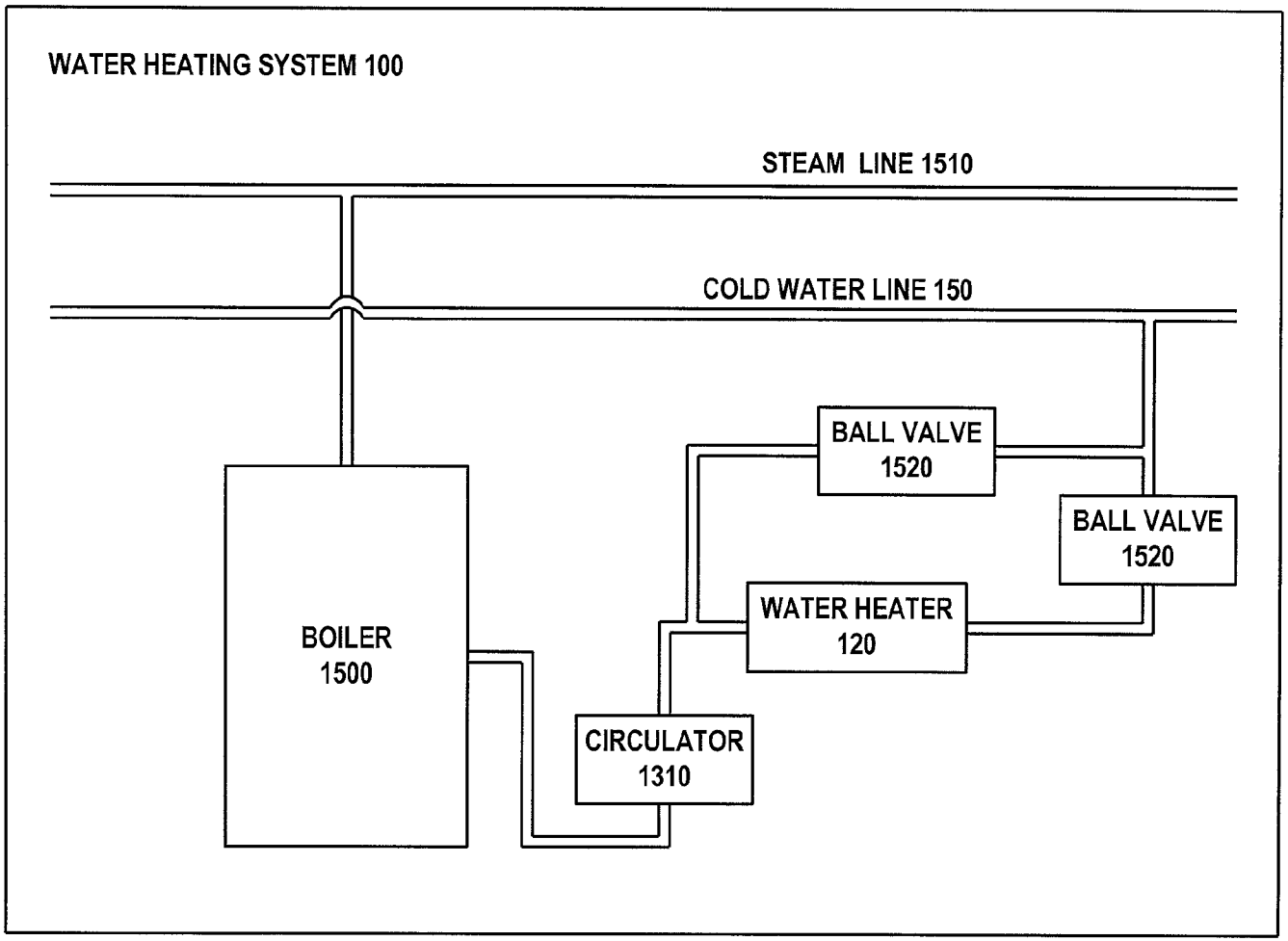
FIG. 15 is a water heating system incorporating an embodiment of the fluid heating apparatus.

FIG. 15 is a water heating system 100 incorporating an embodiment of fluid heating apparatus 120. Boiler 1500 is a steam source in an industrial, commercial, or possibly a residential application. The steam may be used for a radiator heater system or as a power source. Boiler 1500 supplies steam to steam line 1510. Fluid heating apparatus 120 is used as the heat source to convert cold water from cold water line 150 into steam to provide to boiler 1500. Cold water line 150 supplies cold water, which goes through ball valves 1520. One ball valve 1520 is connected to an input of fluid heating apparatus 120, the other is connected to an output of fluid heating apparatus 120. Circulator 1310 connects an output of fluid heating apparatus 120 and boiler 1500.

In operation, ball valves 1520 are controlled so as to regulate the temperature at an output of fluid heating apparatus 120. Ball valve 1520 connected to an input of fluid heating apparatus 120 supplies hot water or steam to an output of fluid heating apparatus 120. Ball valve 1520 connected to an output of fluid heating apparatus 120 supplies cold water to an output of fluid heating apparatus 120. The hot water or steam and cold water mix at an output of fluid heating apparatus 120 in a proportion resulting in a desired output water/steam temperature for supply to boiler 1500. Circulator 1310 pumps the water/steam at an output of fluid heating apparatus 120 into boiler 1500. Ball valve 1520 that is connected to an output of fluid heating apparatus 120 acts as a safety to prevent catastrophic failure of Boiler 1500. Boilers have a tendency to explode in undesirable or unusual operating conditions. This can cause human injuries and property damage. Ball valve 1520 connected to an output of fluid heating apparatus 120 can supply cold water to the output of fluid heating apparatus 120, which is pumped by circulator 1310 into boiler 1500. This could prevent a dangerous buildup of steam pressure and lower the temperature within boiler 1500, thereby preventing catastrophic failure.

Although the invention has been described with reference to embodiments herein, those embodiments do not limit the scope of the invention. Modification to those embodiments or different embodiments may fall within the scope of the invention.

What is claimed is:

1. A fluid heating apparatus, comprising:

a housing;

a flattened tube disposed in said housing;

a plurality of lamps disposed in said housing;

a first conduit flow-coupled to the flattened tube, the first conduit being adapted to provide fluid to the flattened tube;

a second conduit flow-coupled to the flattened tube, the second conduit being adapted to channel fluid from the flattened tube;

wherein the lamps are arranged to irradiate the flattened tube, and the flattened tube is adapted to absorb radiation from the lamps and heat fluid contained therein;

wherein at least one of said lamps is arranged adjacent to a first side of said flattened tube; and wherein at least one other of said lamps is arranged adjacent to a second side of said flattened tube opposite said first side.

2. The fluid heating apparatus of claim 1, wherein the lamps are mounted to the housing.

3. The fluid heating apparatus of claim 1, wherein the lamps are mounted to the flattened tube.

4. The fluid heating apparatus of claim 1, further comprising:

a hinged panel on the housing.

5. The fluid heating apparatus of claim 4, wherein the lamps are mounted to the hinged panel.

6. The fluid heating apparatus of claim 1, further comprising:

several hinged panels on the housing;

wherein the lamps are mounted to the several hinged panels.

7. The fluid heating apparatus of claim 1, further comprising:

an insulating layer surrounding the housing.

8. The fluid heating apparatus of claim 1, further comprising:

an insulating layer within the housing.

9. The fluid heating apparatus of claim 8, wherein the insulating layer coats an inner surface of the housing.

10. The fluid heating apparatus of claim 1, wherein the lamps are mounted in direct contact with the flattened tube.

11. The fluid heating apparatus of claim 1, wherein the lamps are arranged in matching pairs on either side of the flattened tube.

12. The fluid heating apparatus of claim 1, wherein the lamps are halogen lamps.

13. The fluid heating apparatus of claim 1, wherein the lamps are heat lamps.

14. A fluid heating apparatus, comprising:

a housing, having a plurality of openings formed therein;

a flattened tube disposed in said housing;

a plurality of lamps, each associated with one of said plurality of openings formed in said housing;

a first conduit flow-coupled to the flattened tube, the first conduit being adapted to provide fluid to the flattened tube;

a second conduit flow-coupled to the flattened tube, the second conduit being adapted to channel fluid from the flattened tube; and wherein the lamps are arranged to irradiate the flattened tube, and the flattened tube is adapted to absorb radiation from the lamps and heat fluid contained therein.

15. The fluid heating apparatus of claim 14, wherein each of the plurality of lamps is mounted to the housing by at least one hinge.

16. The fluid heating apparatus of claim 14, wherein at least one of said lamps is arranged adjacent to a first side of said flattened tube and wherein at least one other of said lamps is arranged adjacent to a second side of said flattened tube opposite said first side.

17. The fluid heating apparatus of claim 14, wherein said openings are rectangular.

* * * * *